US007396113B2

(12) United States Patent
Mita

(10) Patent No.: US 7,396,113 B2
(45) Date of Patent: Jul. 8, 2008

(54) INKJET RECORDING HEAD, INKJET RECORDING APPARATUS AND METHOD FOR MANUFACTURING INKJET RECORDING HEAD

(75) Inventor: Tsuyoshi Mita, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 11/826,012

(22) Filed: Jul. 11, 2007

(65) Prior Publication Data

US 2007/0257967 A1 Nov. 8, 2007

Related U.S. Application Data

(62) Division of application No. 10/947,311, filed on Sep. 23, 2004, now Pat. No. 7,270,404.

(30) Foreign Application Priority Data

Sep. 24, 2003 (JP) ..... 2003-332470

(51) Int. Cl.
*B41J 2/045* (2006.01)

(52) U.S. Cl. ..... 347/68; 347/70; 347/71

(58) Field of Classification Search ..... 347/69, 347/72, 70, 71
See application file for complete search history.

(56) References Cited

U.S. PATENT DOCUMENTS 6,584,660 B1 7/2003 Shimogawa et al.

FOREIGN PATENT DOCUMENTS

| | | | |
|---|---|---|---|
| JP | 5-286142 A | | 11/1993 |
| JP | 05-330069 A | | 12/1993 |
| JP | 05330069 A | * | 12/1993 |
| JP | 06-115070 A | | 4/1994 |
| JP | 10-128972 A | | 5/1998 |
| JP | 10-329320 A | | 12/1998 |

OTHER PUBLICATIONS

Machine Translation of JP 05330069 to Suzuki, Kazunaga et al.*

* cited by examiner

*Primary Examiner*—Matthew Luu
*Assistant Examiner*—Lisa M Solomon
(74) *Attorney, Agent, or Firm*—Birch, Stewart, Kolasch & Birch, LLP

(57) ABSTRACT

The inkjet recording head comprises: a plurality of ink chambers aligned, each of the plurality of ink chambers having a nozzle; and a piezoelectric element arranged on an outer side of the plurality of ink chambers, the piezoelectric element using displacement in d31 direction, piezoelectric strain absorbing holes being formed through the piezoelectric element in regions of outer perimeters of active sections of the piezoelectric element, wherein when voltage is applied to one of the active sections of the piezoelectric element, corresponding one of the plurality of ink chambers is compressed by the piezoelectric element, and ink filled in the one of the plurality of ink chambers is discharged through the nozzle toward a recording medium.

1 Claim, 8 Drawing Sheets

SINGLE GREEN SHEET

SCREEN PRINTING OF COMMON ELECTRODE

TURN OVER

SCREEN PRINTING OF DISCRETE ELECTRODES

FORMING HOLES BY PRESSING MACHINE

DEGREASING AND CALCINING

BONDED WITH VIBRATION PLATE

INKJET RECORDING HEAD, INKJET RECORDING APPARATUS AND METHOD FOR MANUFACTURING INKJET RECORDING HEAD

This Nonprovisional application claims priority under 35 U.S.C. §119(a) on Patent Application No(s). 2003-332470 filed in Japan on Sep. 24, 2003, and is a Division of U.S. application Ser. No. 10/947,311, filed Sep. 23, 2004 now U.S. Pat. No. 7,270,404, the entire contents of which are hereby incorporated by reference.

BACKGROUND OF THE INVENTION

1. Field of the Invention

The present invention relates to inkjet recording head, an inkjet recording apparatus and a method for manufacturing an inkjet recording head, and more particularly, to an inkjet recording head, an inkjet recording apparatus, and a method for manufacturing an inkjet recording head, whereby no cross-talk is generated.

2. Description of the Related Art

An inkjet printer used as an image forming apparatus, such as a printer, a facsimile apparatus, a copying apparatus, or the like, forms images on paper by discharging ink from nozzles of pressure chambers, in accordance with image forming data.

Ink discharging devices based on a piezo-actuator using a piezoelectric element, which deforms in accordance with an electric signal, are known. In a piezo-actuator method, a pressure wave is applied to a pressure chamber by deforming the wall of the pressure chamber by means of a piezoelectric element, thereby causing ink to be discharged from the nozzle of the pressure chamber, and therefore it is possible to generate a strong pressure wave by means of a low drive energy. In recent years, inkjet printers have been required to form images of high precision and resolution, and it has become necessary to eliminate differences in the flight characteristics of ink droplets, when one nozzle is driven and when a plurality of nozzles are driven, and to eliminate the generation of accidental droplets due to cross-talk between one pressure chamber and an adjacent pressure chamber. As a method for resolving these requirements, Japanese Patent Application Publication No. 10-329320 discloses that cross-talk is prevented by forming strain absorbing holes in two or three of the outer edges of the pressure chamber of the piezoelectric element.

In the recording head disclosed in Japanese Patent Application Publication No. 10-329320, the piezoelectric elements corresponding to respective nozzles are connected partially with the adjacently positioned piezoelectric elements, and hence a problem arises in that cross-talk cannot be completely eliminated. Moreover, the recording head disclosed in Japanese Patent Application Publication No. 10-329320 is formed by stacking green sheets in multilayer on which strain absorbing holes have been formed, and it is difficult to register the small strain absorbing holes in position, and hence productivity declines. Moreover, in an inkjet printer head based on a method wherein ink is discharged by using a bimorph effect between a vibration plate and a piezoelectric body, as in the present example, since the displacement of the piezoelectric body in a lateral direction is utilized, there is a very significant effect on adjacent nozzles if a structure is adopted wherein all of the piezoelectric bodies are connected.

SUMMARY OF THE INVENTION

The present invention is contrived in view of such circumstances, and an object thereof is to provide an inkjet recording head, an inkjet recording apparatus and a method for manufacturing an inkjet recording head whereby cross-talk is prevented, whilst also achieving excellent productivity.

In order to attain the above-described object, the present invention is directed to an inkjet recording head, comprising: a plurality of ink chambers aligned, each of the plurality of ink chambers having a nozzle; and a piezoelectric element arranged on an outer side of the plurality of ink chambers, the piezoelectric element using displacement in d31 direction, piezoelectric strain absorbing holes being formed through the piezoelectric element in regions of outer perimeters of active sections of the piezoelectric element, wherein when voltage is applied to one of the active sections of the piezoelectric element, corresponding one of the plurality of ink chambers is compressed by the piezoelectric element, and ink filled in the one of the plurality of ink chambers is discharged through the nozzle toward a recording medium.

According to the present invention, since the piezoelectric strain absorbing holes passing through the piezoelectric element are formed in the piezoelectric element in the regions of the outer perimeters of the active sections (i.e., the discrete electrodes, the pressure chambers), then stress generated by piezoelectric strain is eliminated by means of the piezoelectric strain absorbing holes and hence cross-talk can be prevented.

Preferably, the inkjet recording head further comprises a vibration plate which defines the plurality of ink chambers, grooves being formed on the vibration plate at positions opposing the piezoelectric strain absorbing holes in the piezoelectric element. According to this, it is possible further to alleviate the stress generated in the vibration plate by piezoelectric strain, and hence elimination of cross-talk is promoted.

Preferably, the vibration plate and the piezoelectric element are bonded by means of adhesive, and the piezoelectric strain absorbing holes form escape regions for surplus adhesive during bonding. According to this, any surplus adhesive enters into the piezoelectric strain absorbing holes, thereby enabling stable bonding of the vibration plate and the piezoelectric element. Moreover, the drying time for the adhesive can also be shortened by means of the piezoelectric strain absorbing holes.

The present invention is also directed to an inkjet recording apparatus, comprising: a plurality of ink chambers aligned, each of the plurality of ink chambers having a nozzle; and a piezoelectric element arranged on an outer side of the plurality of ink chambers, the piezoelectric element using displacement in d31 direction, piezoelectric strain absorbing holes being formed through the piezoelectric element in regions of outer perimeters of active sections of the piezoelectric element, wherein when voltage is applied to one of the active sections of the piezoelectric element, corresponding one of the plurality of ink chambers is compressed by the piezoelectric element, and ink filled in the one of the plurality of ink chambers is discharged through the nozzle toward a recording medium.

The present invention is also directed to a method for manufacturing the inkjet recording head, comprising the steps of: forming a common electrode onto a first surface of a single green sheet by means of a screen printing; then forming discrete electrodes onto a second surface of the green sheet by means of screen printing; then forming the piezoelectric strain absorbing holes in the green sheet in the regions of the outer peripheries of the discrete electrodes by means of a pressing machine; then calcining the green sheet to form the piezoelectric element using displacement in d31 direction; and then bonding the piezoelectric element to a vibration plate.

According to the present invention, since the piezoelectric strain absorbing holes are processed after forming the common electrode and the discrete electrodes, whereupon the vibration plate is bonded, it is possible to prevent strain or damage to the vibration plate, which is liable to the vibration plate, during forming and processing, and hence productivity can be increased.

In the present specification, the term "recording" indicates the concept of forming images in a broad sense, including text. Furthermore, "recording medium" indicates a medium on which an image is formed by means of a recording head (this medium may be called an image forming medium, recording medium, image receiving medium, recording paper, or the like), and this term includes various types of media, irrespective of material and size, such as continuous paper, cut paper, sealed paper, resin sheets, such as OHP sheets, film, cloth, and other materials.

According to the present invention, cross-talk can be prevented, and productivity can be improved.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
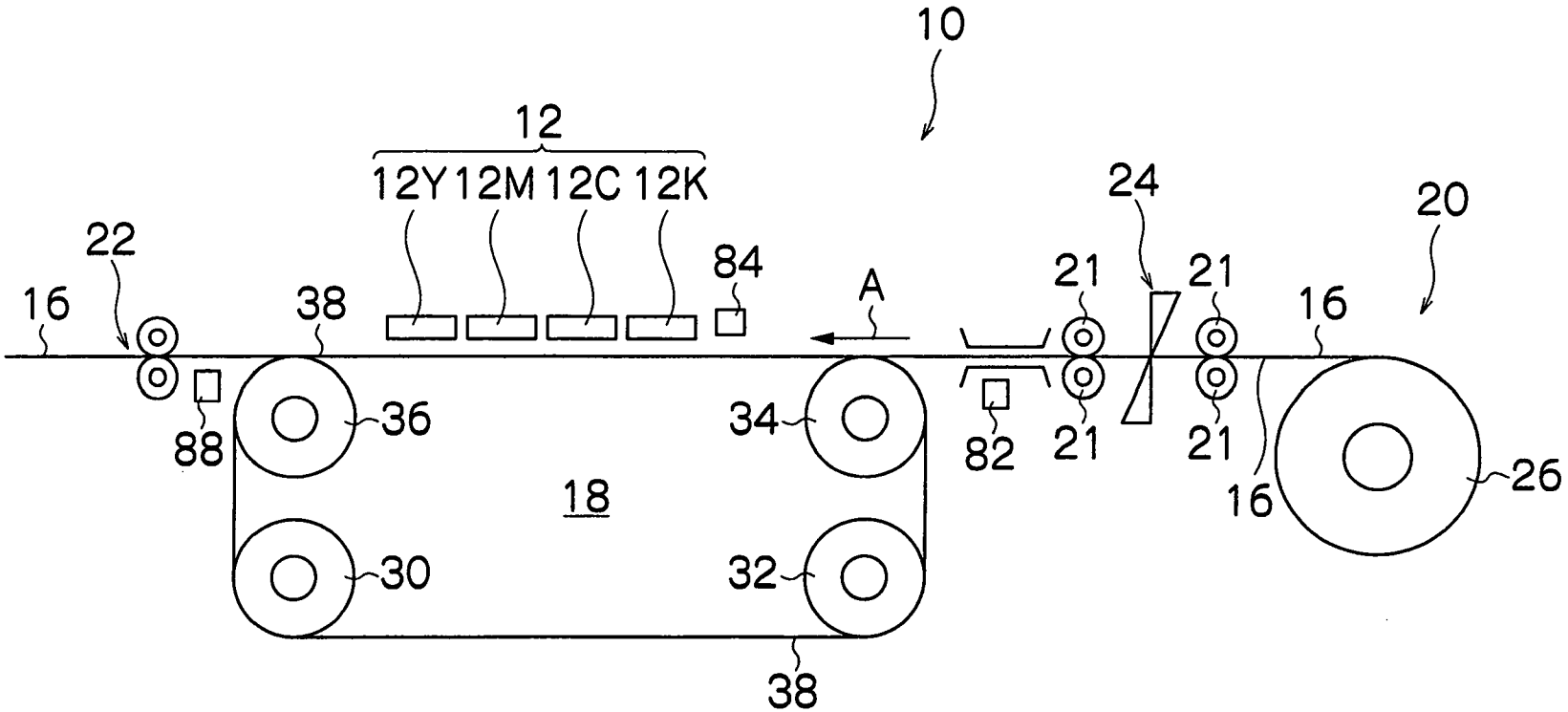
FIG. 1 is a side view showing an image forming apparatus according to an embodiment of the present invention.

Below, an embodiment of an inkjet recording head, an inkjet recording apparatus and a method for manufacturing an inkjet recording head are described with reference to the accompanying drawings. FIG. 1 is a side view showing a schematic illustration of the composition of an image forming apparatus 10 to which an inkjet recording head, an inkjet recording apparatus and a method for manufacturing an inkjet recording head according to a first embodiment are applied.

The image forming apparatus 10 comprises: a recording head 12; a belt conveyance unit 18 for conveying recording paper 16 whilst maintaining the recording paper 16 in a flat state, disposed in a position opposing the recording head 12; a paper supply unit 20 for supplying recording paper 16; and a paper output section 22 for outputting recording paper externally, once an image has been formed thereon.

The recording head 12 is constituted by a so-called full line type head, wherein a line type head having a length corresponding to the width of the recording paper 16 is disposed in a fixed position, in a direction orthogonal to the paper conveyance direction. Recording heads 12K, 12C, 12M, 12Y corresponding to respective ink colors are disposed in the order, black (K), cyan (C), magenta (M) and yellow (Y), from the upstream side, following the direction of conveyance of the recording paper 16 (arrow A). Nozzles (not shown) are formed in each of these recording heads, and a color image, or the like, is formed on the recording paper 16 by discharging ink of the colors from the nozzles, onto the recording paper 16, whilst conveying the recording paper 16. The details of the recording head 12 are described hereinafter.

Roll paper 26 is set in place detachably on a paper supply unit 20. Pickup rollers 21 for picking up the recording paper 16 from the roll paper 26 are provided in the vicinity of the paper supply unit 20. The force of a motor (not shown) is transmitted to at least one of the pick-up rollers 21, and the recording paper 16 picked up thereby is conveyed from right to left in FIG. 1. Reference numeral 24 is a shearing cutter disposed between the rollers 21, and the recording paper 16 picked up from the roller paper 26 is cut to a prescribed size by means of the cutter 24.

The belt conveyance unit 18 has a structure wherein an endless belt 38 is wound about rollers 30, 32, 34 and 36, and is composed in such a manner that at least the portion opposing the recording head 12 is a horizontal surface. This belt 38 has a broader width dimension than the width of the recording paper 16, and the recording paper 16 can be suctioned onto the surface of the belt. The drive force of a motor (not shown) is transmitted to at least one of the rollers 30, 32, 34, 36 about which the belt 38 is wound, whereby the belt 38 is driven in a counterclockwise direction in FIG. 1, and hence the recording paper 16 suctioned onto the belt 38 is conveyed from right to left in FIG. 1.

Reference numeral 82 denotes a recording determination unit for reading in the position, size, and the like, of the recording paper, reference numeral 84 denotes a recording position determination unit for determining the timing of ink discharge onto the recording paper 16, and reference numeral 88 denotes a recording paper end detection unit for detecting a stacking of the recording paper 16 and for determining the supply timing of the next sheet. Furthermore, the image forming apparatus 10 has a system controller (not shown) which controls the whole image forming apparatus 10 on the basis of the detection results from these detection units. The system controller is constituted by a central processing unit (CPU) and peripheral circuits, and the like, and it generates, for example, drive signals and control signals for the motors for conveying the recording paper 16, and image forming signals for the recording head 12, and the like.

Figure 2:
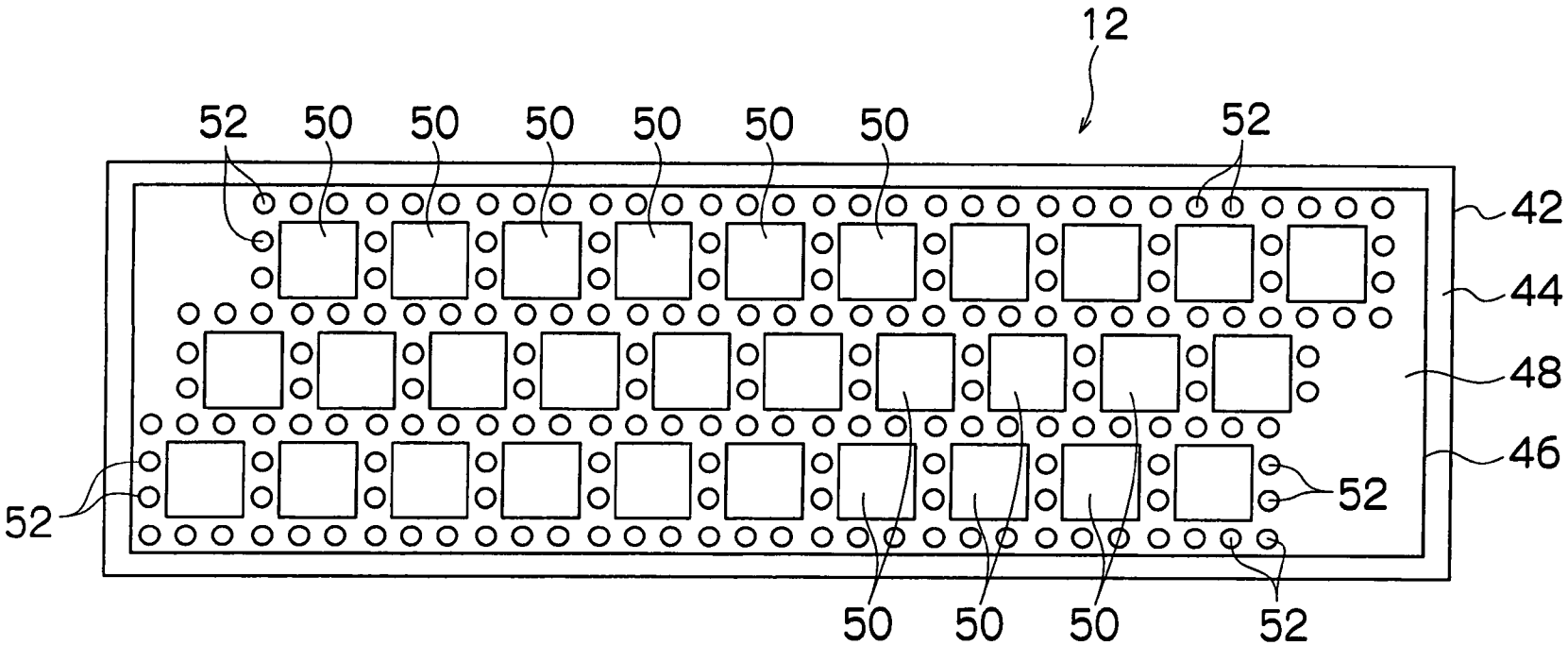
FIG. 2 is a plan view showing an inkjet recording head according to an embodiment of the present invention.

Next, the structure of the recording head 12 will be described. Since the structure of the recording heads 12K, 12C, 12M and 12Y provided for the ink colors are similar, each of the recording heads is denoted with the reference numeral 12 hereinafter, as a representative example of the recording heads. FIG. 2 is a plan view of the recording head 12, and FIG. 3 is a partial enlarged cross-sectional view of the recording head 12.

Figure 3:
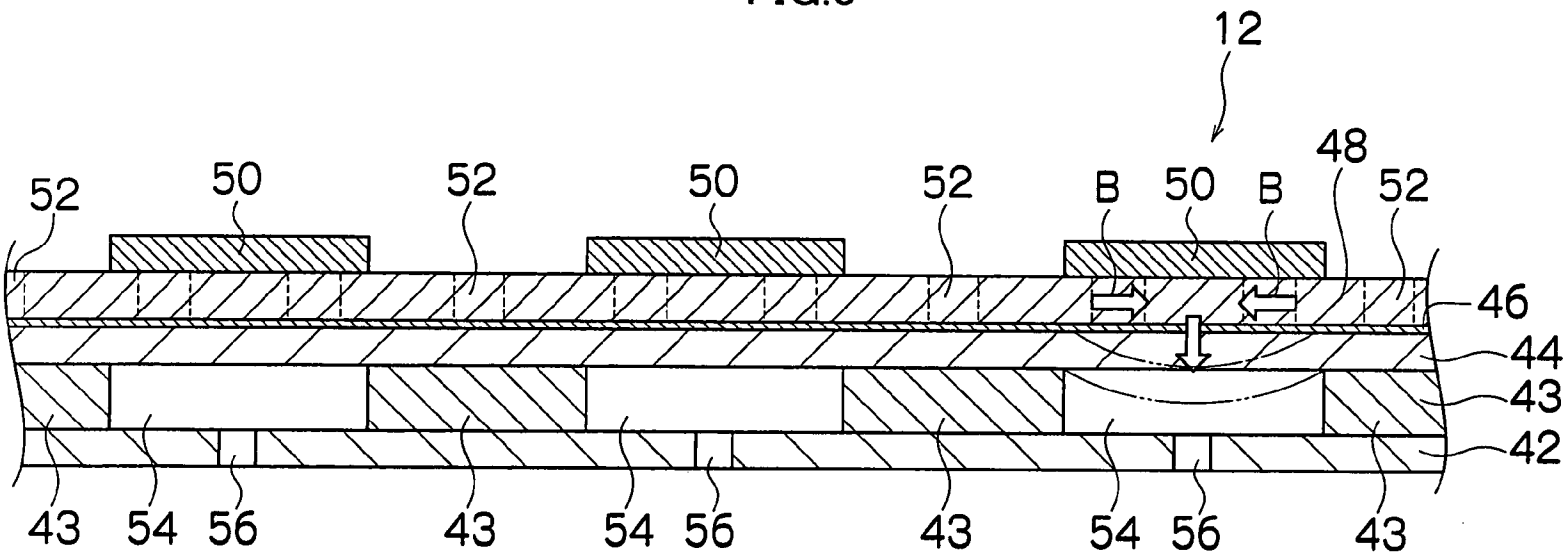
FIG. 3 is a partial enlarged cross-sectional view showing the detailed structure the inkjet recording head.
Figures 4A, 4B, 4C, 4D, 4E:
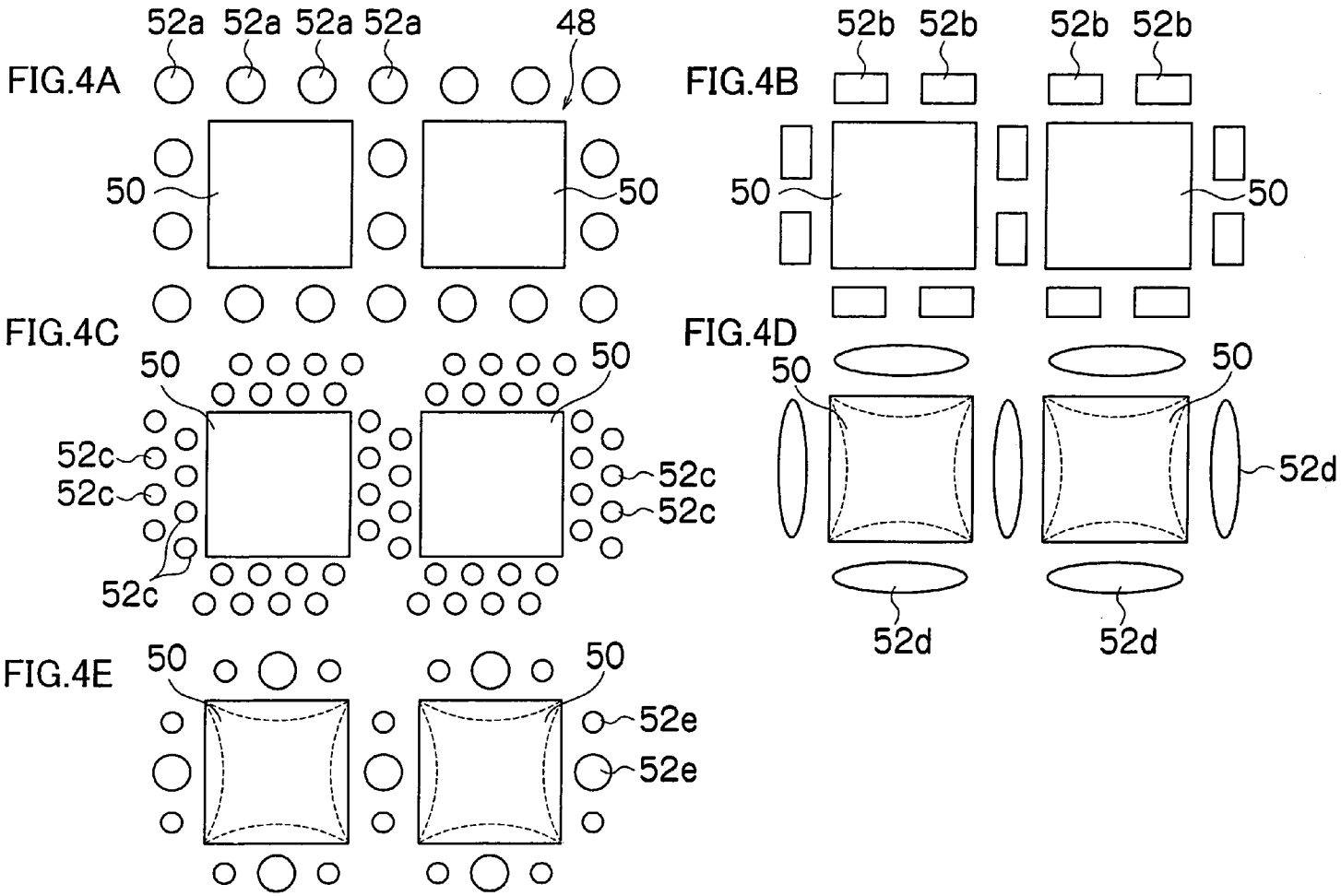
FIGS. 4A to 4E are plan views showing other embodiments of piezoelectric strain absorbing holes.

As shown in FIG. 3, the recording head 12 is composed of a nozzle plate 42 formed in a square plate shape, partitions 43, a vibration plate 44, a common electrode 46, a piezoelectric element 48, discrete electrodes 50, and the like. As shown in FIG. 3, pressure chambers 54 are formed by the empty spaces enclosed by the nozzle plate 42, the plurality of partitions 43, and the vibration plate 44, and the pressure chambers 54 are disposed in a staggered matrix arrangement in the positions indicated by the reference numerals 50 in FIG. 2. The pressure chambers 54 are connected to an ink supply passage (not shown), whereby ink is supplied to the interior of the pressure chambers 54.

A nozzle 56 connected to the lower face of the nozzle plate 42 is formed through the nozzle plate 42 in a position corresponding to the lower portion of each of the pressure chambers 54. The vibration plate 44 is arranged on the ceiling face of the pressure chambers 54 in such a manner that the vibration plate 44 seals the pressure chambers 54, and the grounded common electrode 46 is arranged on the upper face of the vibration plate 44.

The piezoelectric element 48 is a single plate, and has a rectangular shape similar to the nozzle plate 42. The piezoelectric element plate 48 is arranged on the upper face of the common electrode 46. The discrete electrodes 50 are arranged on the upper face of the piezoelectric element 48, in positions opposing the pressure chambers 54. When an electric field is applied to the piezoelectric element 48 in the vertical direction in FIG. 3, by means of the discrete electrode 50 and the common electrode 46, the piezoelectric element 48 deforms in a lateral direction (mode d31), in other words, in the directions of arrows B in FIG. 3. The piezoelectric element 48 is connected on the vibration plate 44 through the common electrode 46 and when the piezoelectric element 48 deforms in the lateral direction, both the piezoelectric element 48 and the vibration plate 44 bend downwards as represented with alternate long and two short dashes lines in FIG. 3, thereby causing the volume of the pressure chamber 54 to change, and thus applying a pressure wave to the pressure chamber 54.

In the regions of the four outer edges of the discrete electrodes 50 on the piezoelectric element 48, a plurality of piezoelectric strain absorbing holes 52 are formed. The piezoelectric strain absorbing holes 52 are formed passing in a direction orthogonal to the sheet of FIG. 2.

When a drive voltage is applied to the discrete electrode 50, the vibration plate 44 deforms due to the deformation of the piezoelectric element 48 as shown with the alternate long and two short dashes lines in FIG. 3, thereby causing the volume of the pressure chamber 54 to change, and thus applying a pressure wave to the pressure chamber 54, in response to which ink is discharged from the nozzle 56. A connection circuit board (not shown) for providing electrical connections to a drive circuit for applying drive voltage to the discrete electrodes 50 provided inside the image forming device 10, is installed in the recording head 12.

Next, the action of the recording head 12 having the composition described above will be explained.

In order to form an image on the basis of an image forming pattern, drive voltages are applied to the discrete electrodes 50 from the drive circuit, in accordance with a system controller. As shown in FIG. 3, the piezoelectric element 48 deforms in a lateral direction (the directions of the arrows B in FIG. 3), and the vibration plate 44 forming the ceiling face of the pressure chamber 54 bends projectingly towards the pressure chamber 54 as shown with the alternate long and two short dashes lines in FIG. 3, whereby a pressure wave is applied to the pressure chamber 54. Upon application of the pressure wave, ink is discharged from the pressure chamber 54 through the nozzle 56. The ink thus discharged is deposited onto the recording face of the recording paper 16, whereby an image is formed on the recording paper 16. When the application of the drive voltage is terminated, the piezoelectric element 48 and the vibration plate 44 which had deformed revert to their state prior to deformation. When they revert in this manner, new ink of approximately the same volume as the ink that has been discharged is supplied to the pressure chamber 54 from the ink supply passage (not shown). This ink discharging operation is performed repeatedly, and an image based on an image forming pattern is formed on the recording paper 16 as it is conveyed.

Here, when the piezoelectric element 48 is deformed in the lateral direction, internal stress arises in the piezoelectric element 48 to the outer sides of the discrete electrode 50, but this internal stress is eliminated by means of the piezoelectric strain absorbing holes 52. More specifically, since the piezoelectric strain absorbing holes 52 are formed in the piezoelectric element 48, which bends and deforms together with the vibration plate 44, in the region of the outer perimeter of the discrete electrode (active element) 50, then it is possible to eliminate cross-talk to the piezoelectric element 48 at other adjacently positioned pressure chambers.

As shown in FIGS. 4A to 4E, various shapes and positional configurations may be adopted for the piezoelectric strain absorbing holes 52. In an example shown in FIG. 4A, piezoelectric strain absorbing holes 52*a* are disposed along the four outer edges of each discrete electrode 50 as in the above-described embodiment. In an example shown in FIG. 4B, rectangular shaped piezoelectric strain absorbing holes 52*b* are disposed along the four outer edges of each discrete electrode 50. In an example shown in FIG. 4C, piezoelectric strain absorbing holes 52*c* are disposed in a staggered matrix arrangement along the four outer edges of each discrete electrode 50. In an example shown in FIG. 4D, oval-shaped piezoelectric strain absorbing holes 52*d* are disposed along the four outer edges of each discrete electrode 50. In an example shown in FIG. 4E, piezoelectric strain absorbing holes 52*e* of different sizes are disposed along the four outer edges of each discrete electrode 50.

The piezoelectric element 48 according to the present embodiment is constituted by a single plate, and hence costs are low and processing is straightforward.

Next, a method for manufacturing the piezoelectric element 48 used in the recording head 12 according to the present embodiment is described with reference to FIGS. 5A to 5E. This process advances sequentially from FIG. 5A to FIG. 5E.

Figure 5A:
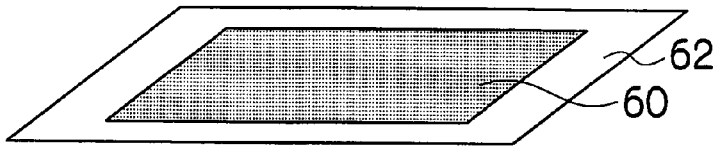
FIGS. 5A to 5E are descriptive diagrams showing a method for manufacturing the inkjet recording head.

Firstly, in FIG. 5A, a green sheet 60 is laid provisionally on a base plate 62.

Figure 5B:
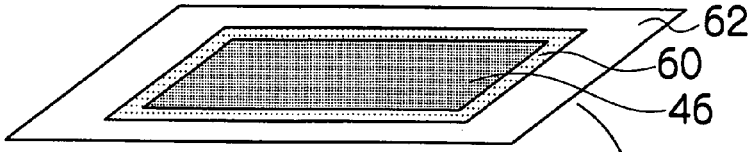

As shown in FIG. 5B, a common electrode 46 is printed onto the surface of the green sheet 60, by means of a screen printing technique.

Figure 5C:
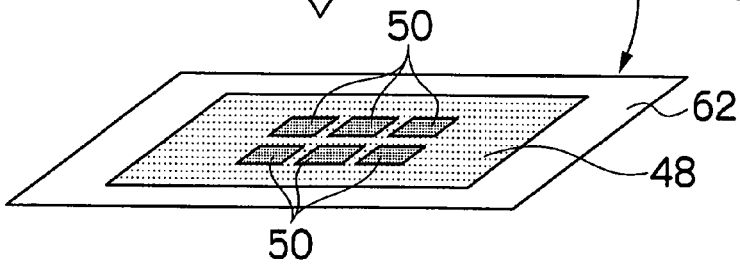

As shown in FIG. 5C, the green sheet 60 is turned over from the state in FIG. 5B, and discrete electrodes 50 are then printed onto the other surface (i.e., reverse to the surface on which the common electrode 46 has been formed) of the green sheet 60, by means of a screen printing technique. The positions at which the discrete electrodes 50 are formed are previously set in such a manner that they correspond to nozzles 56 arranged in a matrix configuration.

Figure 5D:
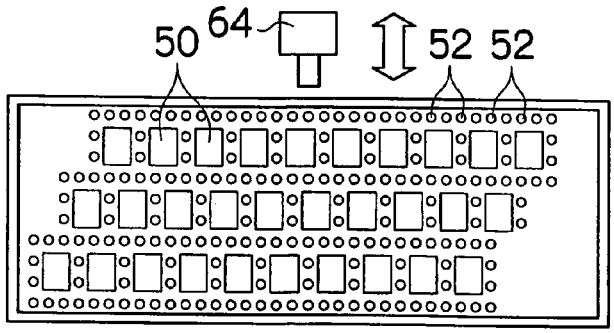

As shown in FIG. 5D, piezoelectric strain absorbing holes 52 are then pierced in the green sheet 60, by means of a pressing machine 64.

Figure 5E:
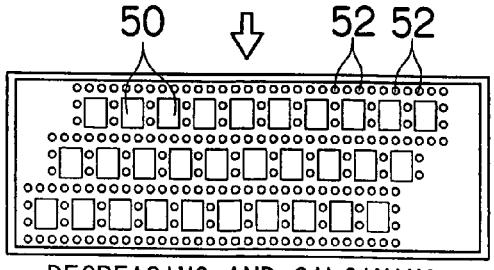

As shown in FIG. 5E, after degreasing the green sheet 60, it is calcined, thereby forming a plate of piezoelectric element 48. Thereupon, the plate of piezoelectric element 48 is bonded to a vibration plate 44 (FIG. 3), whereby the formation process for the piezoelectric element 48 relating to the present embodiment is completed.

Figure 6:
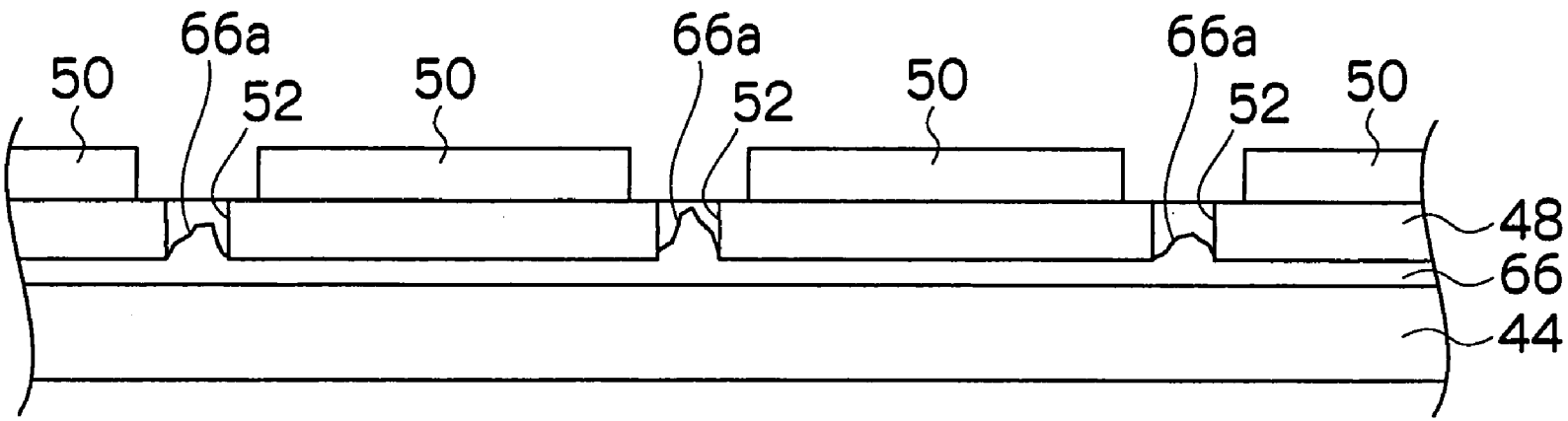
FIG. 6 is a detailed cross-sectional diagram showing the inkjet recording head.

Here, as shown in FIG. 6, the vibration plate 44 and the piezoelectric element 48 are bonded by means of adhesive 66. In this case, the piezoelectric strain absorbing holes 52 form escape regions for surplus adhesive 66*a*, and as shown in FIG. 6, stable bonding of the vibration plate 44 and the piezoelectric element 48 is achieved by means of the surplus adhesive 66*a* entering into the piezoelectric strain absorbing holes 52.

Next, the inkjet recording head relating to a second embodiment of the present invention is described with reference to FIGS. 7A and 7B. Elements which are the same or similar to those of the first embodiment illustrated in FIG. 2 and FIG. 3 are denoted with similar reference numerals and detailed description thereof is omitted here.

Figure 7A:
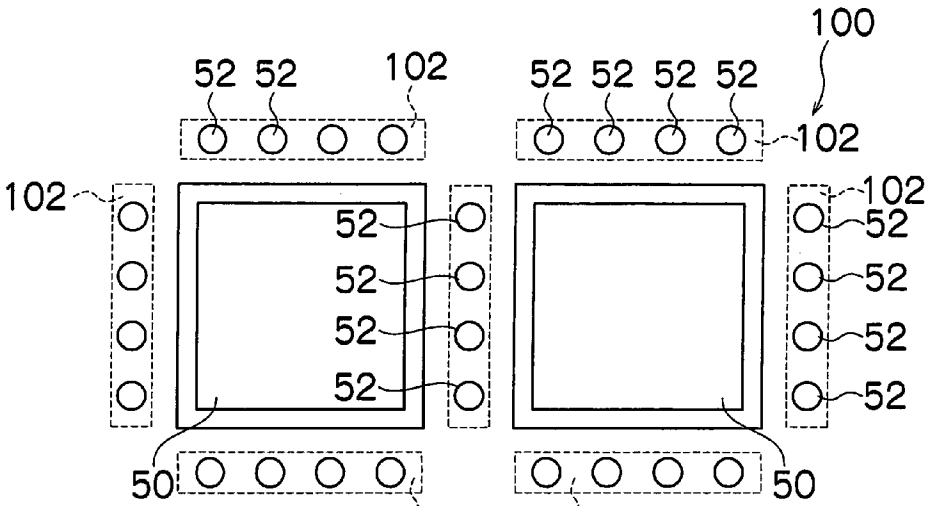
FIG. 7A is a detailed plan view showing an inkjet recording head according to another embodiment of the present invention.
Figure 7B:
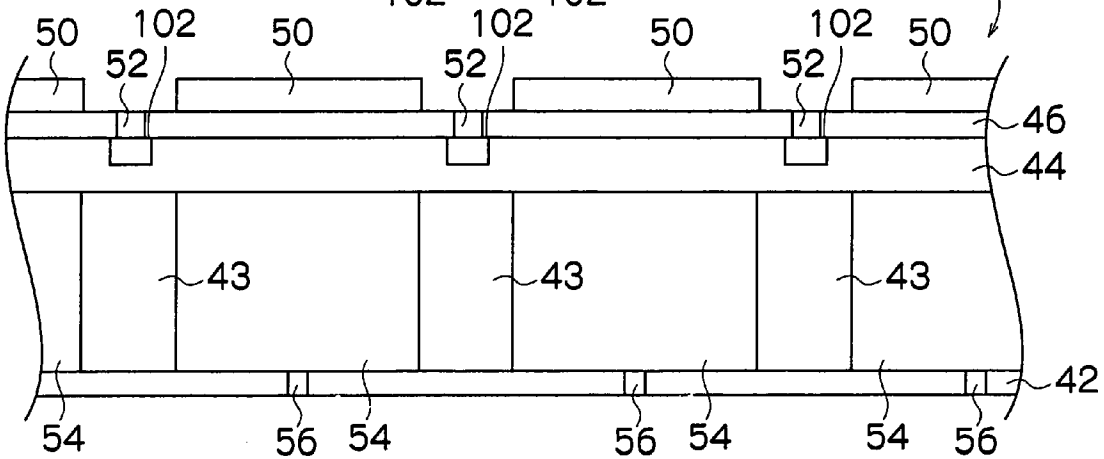
FIG. 7B is a cross-sectional view of FIG. 7A.

As shown in FIGS. 7A and 7B, in the recording head 100 relating to the present embodiment, grooves 102 for absorbing piezoelectric strain are formed in the vibration plate 44 in positions opposing the piezoelectric strain absorbing holes 52.

According to the recording head 100 composed as described above, it is possible further to alleviate any stress generated in the vibration plate 44 by piezoelectric strain, and therefore, the elimination of cross-talk can be promoted.

Figure 8:
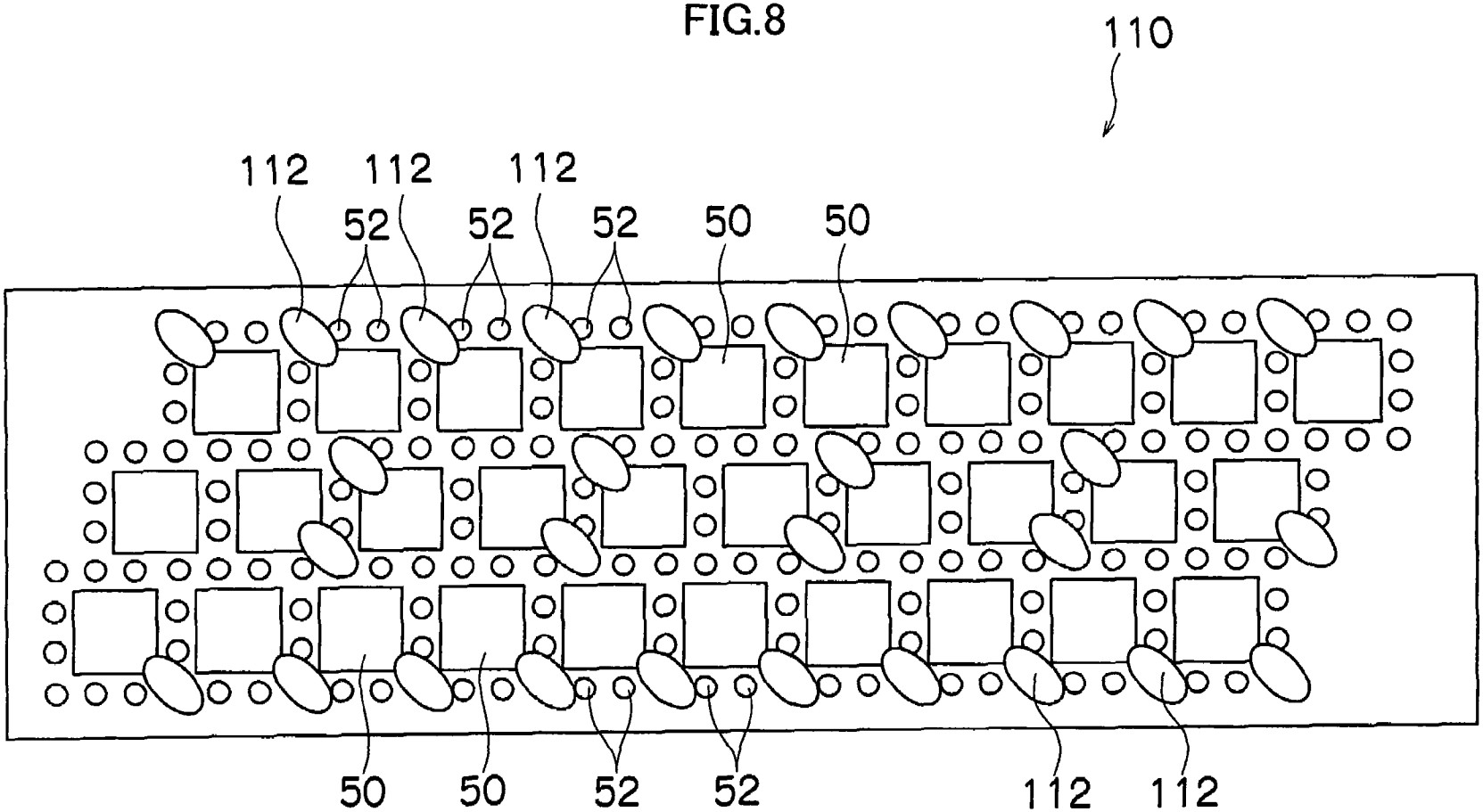
FIG. 8 is a detailed plan diagram showing an inkjet recording head relating to a further embodiment of the present invention.

The composition of the inkjet recording head, the inkjet recording apparatus and the method for manufacturing an inkjet recording head indicated in the embodiments described above are not limited to the foregoing embodiments. For example, as shown in FIG. 8, it is also possible to solder electrode lead sections 112 for the discrete electrodes 50 onto the sections where no piezoelectric strain absorbing holes 52 are formed, by means of a ball grid array, or the like, as in the recording head 110. In this way, the electrodes from the discrete electrodes 50 can be wired in an integrated fashion, by means of these electrode lead sections 112.

Moreover, although the discrete electrodes 50 are formed by screen printing before calcining in the above-described embodiments, the invention is not limited to this, and they may also be installed by sputtering, vapor deposition, or the like, after calcining.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording head, comprising:

a plurality of ink chambers arranged in a two dimensional matrix, each of the plurality of ink chambers having a nozzle; and a piezoelectric element arranged on an outer side of the plurality of ink chambers, the piezoelectric element using displacement in d31 direction, a plurality of piezoelectric strain absorbing holes being formed through the piezoelectric element in regions of outer perimeters of active sections of the piezoelectric element so that each of the active sections is enclosed on all outer sides thereof by the piezoelectric strain absorbing holes, at least three of the piezoelectric strain absorbing holes being arranged along each of edges of each of the active sections so that a size of the piezoelectric strain absorbing hole at a position corresponding to a center of said each of the edges of each of the active sections is larger than a size of the piezoelectric strain absorbing hole at a position corresponding to a periphery of said each of the edges of each of the active sections, wherein when voltage is applied to one of the active sections of the piezoelectric element, a corresponding one of the plurality of ink chambers is compressed by the piezoelectric element, and ink filled in the corresponding one of the plurality of ink chambers is discharged through the nozzle toward a recording medium.

* * * * *